United States Patent [19]

duPont

[11] 4,201,164

[45] May 6, 1980

[54] ENGINE ECONOMIZER CONTROL UNIT

[76] Inventor: Anthony A. duPont, 21515 Hawthorne Blvd., Torrance, Calif. 90503

[21] Appl. No.: 842,415

[22] Filed: Oct. 17, 1977

[51] Int. Cl.[2] ..... F02D 39/00

[52] U.S. Cl. ..... 123/117 R; 123/119 R

[58] Field of Search ..... 123/117 R, 119 R, 98; 261/DIG. 2

[56] References Cited

U.S. PATENT DOCUMENTS

| | | | |
|---|---|---|---|
| 2,069,931 | 2/1937 | Trott | 123/98 |
| 2,407,652 | 9/1946 | Costa | 123/117 R |

*Primary Examiner*—Alan Cohan

*Attorney, Agent, or Firm*—Keith D. Beecher

[57] ABSTRACT

A two-position pilot-operated control unit is provided for reducing the fuel-to-air ratio and for simultaneously advancing the ignition of a piston-type aircraft engine so as to achieve a significant saving in fuel consumption during flight operations.

4 Claims, 2 Drawing Figures

ENGINE ECONOMIZER CONTROL UNIT

BACKGROUND OF THE INVENTION

A recent flight test program by the National Aeronautics and Space Administration has demonstrated that a large reduction in fuel consumption by piston engine aricraft during flight operations can be safely achieved by utilizing extremely lean fuel-to-air mixtures. The fuel reduction is achieved by reducing the fuel-to-air ratio to a low level and concomitantly advancing the ignition timing. It was believed in the prior art that a practical implementation of such low fuel-to-air ratios and such advances in ignition timing required a sophisticated electronic computer to coordinate the fuel-to-air ratio, the advance in ignition timing, and the throttle position. It was also believed in the prior art that a continuous variation in the advance in ignition timing during the leaning operation was required in order to effectuate the desired reduction in fuel consumption.

However, a careful review of the National Aeronautics and Space Administration test data obtained in the ground running of a test aircraft engine prior to its flight test, lead the present inventor to the conclusion that the low fuel-to-air ratio may be achieved by a simple two-position controller which switches from a rich fuel-to-air ratio to a lean fuel-to-air ratio of approximately 0.05, or 75% of stoichiometric; and which switches the ignition timing from a normal 20° before top dead center to approximately 35° before top dead center. This conclusion that a two-position controller would be adequate was based on the fact that the minimum fuel consumption achieved by leaning at constant power always occurs at nearly the same fuel-to-air ratio for all engine operating conditions tested.

In order to achieve the desired low fuel-to-air ratio, however, and still avoid rough engine operation as the ratio is decreased, the ignition timing must be advanced. The data revealed that acceptable if not optimum results could be achieved with a constant ignition advance of 35° before top dead center. If the ignition timing is not advanced, the fuel consumption will not decrease beyond a fuel-to-air ratio of 85% and, the engine will run rough and excessively hot at this point. However, leaning the fuel-to-air ration will yield minimum fuel consumption, and at the same time will provide smooth operation and acceptable cylinder head and exhaust temperatures.

SUMMARY

The economizer of the present invention in the embodiment to be described comprises a two-position control unit including a pilot-operated switch which switches the fuel-to-air ratio from rich to approximately 75% of stoichiometric, and which simultaneously advances the ignition timing from 20° before top dead center to aproximately 35° before top dead center. In the practice of the invention, for example, a three position magneto may be provided having a first position for starting, a second position providing a 20° ignition advance for rich burning during normal operation, and a third position providing a 35° ignition advance for lean burning. The control unit is connected to the aircraft engine controls so that the fuel-to-air ratio may be established at more than full stoichiometric and under manual control for the second position of the magneto, and so that the fuel-to-air mixture may be established at a fixed ratio of 75% of stoichiometric for the third position of the magneto.

A safety interlock may be included to limit cylinder pressures to take-off power values, and a further safety interlock may be provided to prevent detonation or engine roughnesses at low power settings and low manifold pressures, when the control unit is switched to the lean position. The interlocks serve to switch the control unit automatically back to its first position of full rich operation, if the manifold pressure exceeds either a predetermined high or a predetermined low interlock limit. This feature prevents the loss of power if while operating at the lean fuel-to-air ratio in the second position the pilot opens the throttle above a predetermined setting and requires maximum power; or prevents rough engine operation if the pilot closes the throttle below a predetermined setting so that manifold pressure drops below a level that is found unsatisfactory for lean operation.

DETAILED DESCRIPTION

Figure 1:
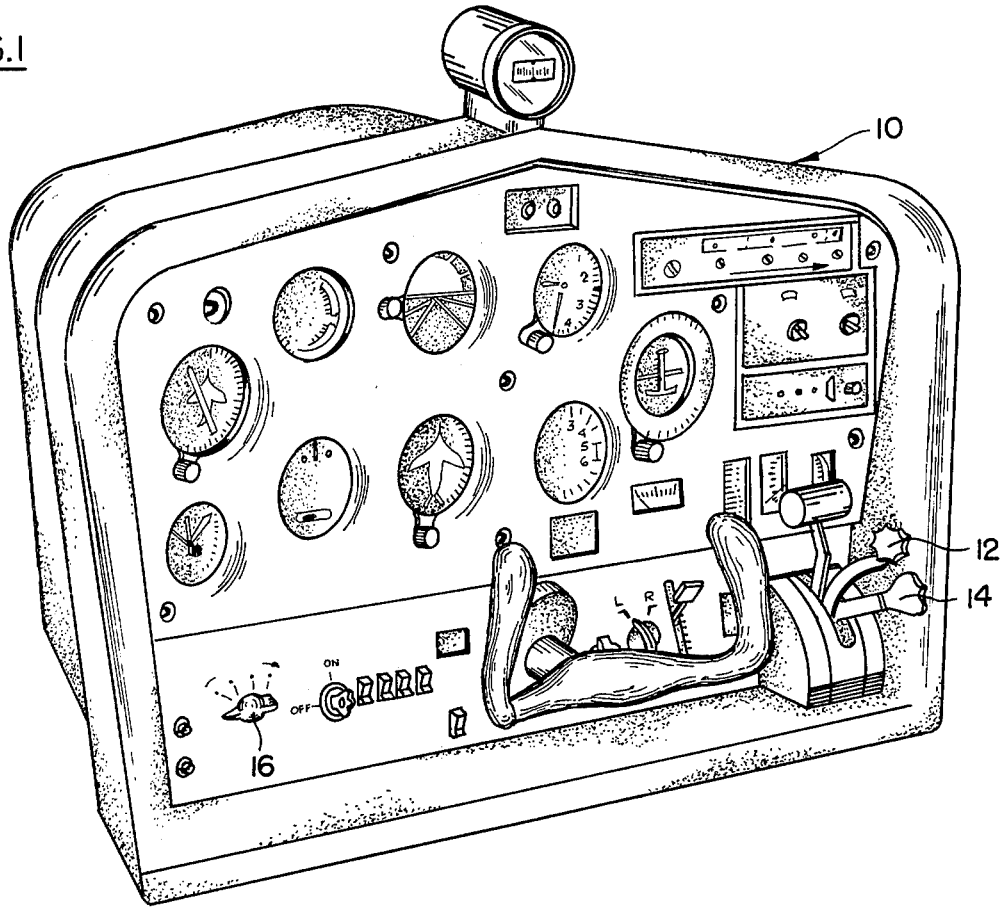
FIG. 1 is a front perspective view of a typical control panel of a piston aircraft.

The instrument panel of FIG. 1 is designated generally as 10. The panel includes a various instruments and controls conventional for the operation of the aircraft. The instrument panel 10 includes, for example, a manual throttle control 12, a manual mixture control 14, and a magneto control switch 16 (which also controls the economizer unit of the invention).

Figure 2:
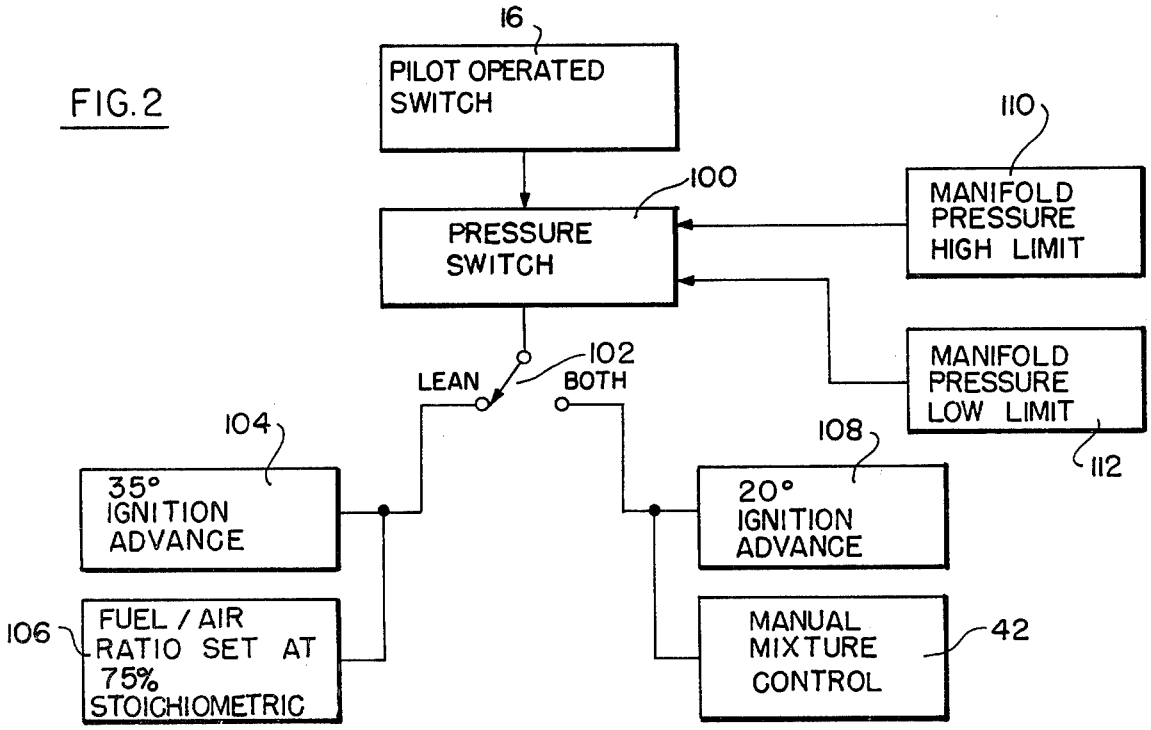
FIG. 2 is a block diagram of one embodiment of the control unit of the invention.

As shown in the block diagram of FIG. 2, switch 16 may be coupled to an appropriate pressure switch 100 which, in turn, operates a switch 102 between first and second positions. In the second position, labelled "lean" in FIG. 2, the switch 102 is connected to a 35° ignition advance control 104, and to a control 106 which sets the fuel-to-air ratio at 75% of stoichiometric, or 0.05. The other, first position, labelled "both" in FIG. 2, switch 102 is connected to a 20° ingition advance control 108 and to be manual mixture control 42. This is the normal operation mode presently used. The controls 104 and 108 may be coupled to the aircraft magneto, so that the magneto is set to establish the ignition at the desired angular advances before top dead center.

Therefore, when the pressure switch 100 permits the switch 102 to be in the illustrated position, the aircraft is set to the lean fuel-to-air ratio, and to the 35° ignition advance, so as to achieve a maximum fuel saving during operation. On the other hand, when the switch arm 102 is set to the other position, the magneto is set to the normal 20° ignition advance, and the manual control 42 is activated to control the fuel-to-air ratio.

An appropriate interlock 110 is provided in the form of a pressure sensor, which causes the pressure switch 100 to set the switch 102 to the right-hand fixed contact automatically whenever the manifold pressure exceeds a predetermined maximum, so as to preserve the structural integrity of the aircraft engine. A second interlock 112 is provided which, likewise, causes the pressure switch 100 to set the switch 102 to the right-hand contact automatically whenever the manifold pressure decreases below a predetermined pressure. The two terlocks serve to switch the aircraft to normal operation under such conditions.

The pilot-operated switch 76 may be mechanically coupled to the manual mixture control 42 so that any attempts to lean the engine beyond the normal limits at 0° ignition advance will actuate the switch, and cause switch 102 to move to its left-hand contact to place the engine in the ultra-lean operating mode.

The invention provides, therefore, a simple control, whereby during operation, the pilot may set the engine in an ultra-lean operating mode with a simultaneous advance in ignition timing to prevent roughness in operation, so that material savings in fuel consumption on the order of 20% to 25% may be realized.

While a particular embodiment of the invention has been shown and described, modifications may be made. It is intended in the claims to cover all modifications which come within the true spirit and scope of the invention.

What is claimed is:

1. A control unit for use in conjunction with a piston engine for providing for reduced fuel consumption during operation of the engine, said control unit including: first ignition control means for providing an ignition timing in the engine of substantially 20° before top dead center; a first manually-controllable mixture control means for providing a relatively rich fuel-to-air ratio in the engine which is manually controllable over a predetermined range; second ignition control means for providing an ignition timing in the engine of substantially 35° before top dead center; second mixture control means for providing a relatively lean fuel-to-air ratio of substantially 75° of stoichiometric in the engine; and switching means for connecting the first ignition control means and the first mixture control means to the engine for one operating position thereof and for connecting the second ignition control means and the second mixture control means to the engine for a second operating position thereof.

2. The control unit defined in claim 1, in which the engine includes a throttle, and which includes an interlock control between the engine and the control unit which establishes the relatively rich fuel-to-air ratio when the throttle is opened beyond a predetermined setting, so as to increase manifold pressure above a predetermined level.

3. The control unit defined in claim 1, in which the engine includes a throttle, and which includes an interlock control interposed between the engine and the control unit which establishes the relatively rich fuel-to-air ratio when the throttle is closed below a predetermined setting so as to cause the manifold pressure to decrease below a particular value.

4. The control unit defined in claim 1, and which includes an interlock connected to the manual mixture control such that moving the mixture control beyond a certain limit moves the switching means into the second position for establishing said lean fuel-to-air ratio in the engine.

* * * * *